United States Patent [19]

Luther et al.

[11] 4,202,270

[45] May 13, 1980

[54] STUB CASE OBTURATOR

[75] Inventors: Hans W. Luther, Kaarst; Hartmut Marwitz, Duesseldorf, both of Fed. Rep. of Germany

[73] Assignee: Rheinmetall GmbH, Duesseldorf, Fed. Rep. of Germany

[21] Appl. No.: 876,201

[22] Filed: Feb. 9, 1978

[30] Foreign Application Priority Data

Feb. 9, 1977 [DE] Fed. Rep. of Germany ..... 2705278

[51] Int. Cl.[2] ..... F42B 9/26; B23P 11/00

[52] U.S. Cl. ..... 102/43 R; 102/44; 102/93; 102/DIG. 1

[58] Field of Search ..... 102/38 CC, 43 R, 43 C, 102/44, DIG. 1, 93

[56] References Cited

U.S. PATENT DOCUMENTS

| | | | |
|---|---|---|---|
| 3,387,560 | 6/1968 | Mertens | 102/44 |
| 3,705,549 | 12/1972 | Quinlan et al. | 102/DIG. 1 |
| 3,771,452 | 11/1973 | Reed et al. | 102/43 R |
| 3,948,178 | 4/1976 | Luther et al. | 102/43 R |

FOREIGN PATENT DOCUMENTS

| | | | |
|---|---|---|---|
| 371382 | 1/1907 | France | 102/43 R |

*Primary Examiner*—Verlin R. Pendegrass

[57] ABSTRACT

A method and means for obturating a stub case on the barrel wall of a firearm is disclosed having an annular bead located near the top of the stub case wall dimensioned so as to provide an annular gap between the bead and the barrel wall thereby throttling the streams of gas flowing back after detonation. The gas is thus permitted to expand and is deflected in a Y-shaped packing ring so that the radial pressure of the gas against the oblique arm of the packing ring provides a satisfactory obturating action.

10 Claims, 3 Drawing Figures

STUB CASE OBTURATOR

The present invention relates to a method and means for obturating a stub case on the barrel wall of a firearm.

Stub cases which perform an obturating function are known. One such stub case contains an annular groove along the circumference of the stub case wall within which is inserted a U or V packing ring. After ignition of the propellant charge, the pressure of the packing ring against the barrel wall accomplishes the obturating action. However, the effectiveness of the obturation in such stub cases diminishes substantially with certain types of powder and at pressures above 4500 bar. This may create a dangerous situation for the weapon as well as the operator. Furthermore, these stub cases do not divert, disperse or otherwise render harmless the axial stream of gas flowing back between the barrel wall and the stub case.

It is an object of the present invention to achieve a satisfactory obturating action on a stub case having a comparatively short obturating distance. It is a further object of the present invention to assure satisfactory obturation in a temperature range of −50° C. to +70° C. and up to a gas pressure of 7000 bar, regardless of the type of powder used or its configuration and regardless of the nature of the combustible composition.

According to the method of the present invention, axial streams of gas produced by detonation, after passing through the upper edge of the stub case, are first throttled then permitted to expand while being deflected inwards into an annular groove space. From there the deflected streams of gas fall into the opening of a Y-shaped packing ring applying radial pressure to effectuate obturation.

Even without this dynamic obturation, the pressure of the packing ring against the barrel wall provides sufficient static obturation to prevent gas seepage.

According to the stub case of the present invention, a stub case is provided so that the outer surface of the stub case, starting from the upper outer edge of the case, first consists of a substantially spherical annular bead. The maximum diameter of the annular bead is smaller, by an annular gap, than that of the barrel wall. A deflection surface extends tangentially inward from the diameter of the annular bead. At the end of the deflection surface a horizontal step extends into an annular groove. The annular groove is fitted with a Y-shaped packing ring consisting of a vertical arm contiguous to the bottom of the annular groove and an arm extending obliquely outward. Thus, the deflected streams of gas fall between the open arms of the packing ring and provide sufficient radial pressure against the oblique arm to perform an obturing function.

In a preferred embodiment of the present invention, the annular bead contains a plurality of axial recesses of rectangular or round cross-section distributed over its perimeter.

The stub case of the present invention is constructed so that the case wall between the annular groove and the base of the stub case is of such thin cross-section and slightly concave on its inner surface so that pressure on the stub case causes distortion of the case wall outwardly and provides an obturating action. Thus, in the event the packing ring is damaged or even in its absence, an adequate obturation of the axial streams of gas can still be achieved.

Although such novel features believed to be characteristic of the invention are pointed out in the claims, the invention may be further understood by reference to the description following and the accompanying drawings.

Figure 1:
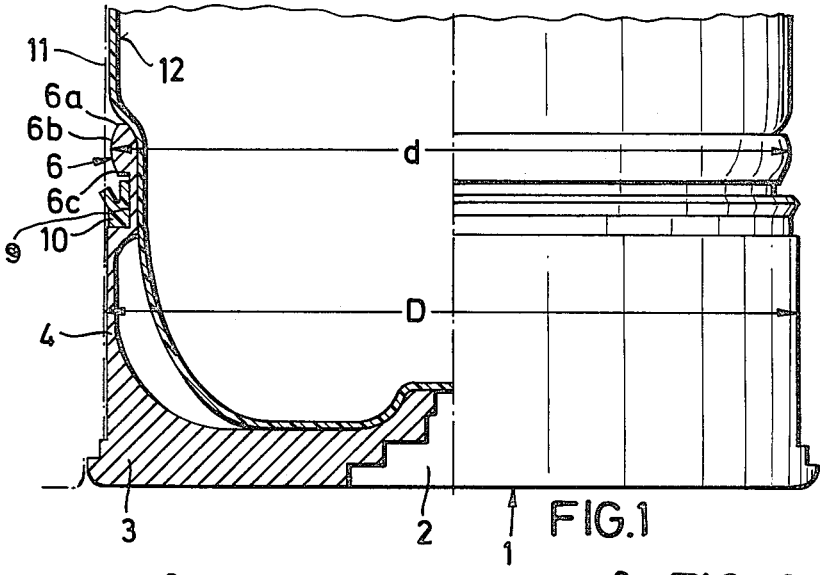
FIG. 1 is a partly longitudinal and partly elevational section of the stub case of the present invention for cartridge type ammunition with a combustible case.
Figure 2:
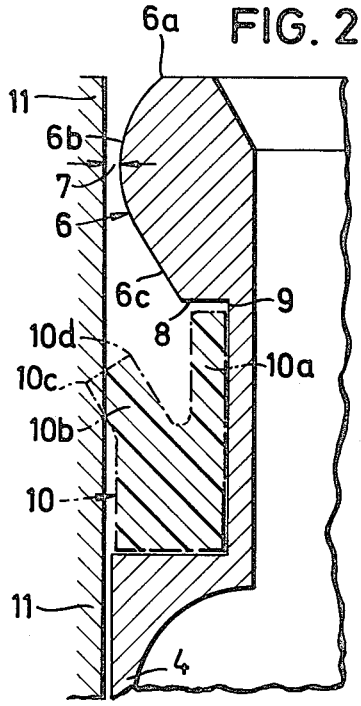
FIG. 2 is a detail of the longitudinal section of FIG. 1 showing the packing ring and annular bead portion of the stub case.

The stub case 1 consists essentially of a base 3 which receives the threaded percussion primer 2 and from which extends a thin case wall 4. In the upper region of the stub case 1, the thin case wall 4 increases in thickness and leads into an annular groove 9 which leads into an annular bead 6. The annular bead 6 consists of an upper edge **6*a* from which a spherical section 6*b* extends and which ends in an inwardly directed tangential deflection surface 6*c*. The deflection surface 6*c* is truncated by step 8 which extends to the bottom of the annular groove 9. The annular groove 9 is fitted with a Y-shaped oridinary commercial resilient packing ring 10. The vertical arm 10*a* of the packing ring 10 bears against the bottom of the annular groove 9, while the shorter but thicker arm 10*b* extends obliquely outwards. The outer edge 10*c* of arm 10*b*, in its quiescent state, is of sufficiently greater diameter than the diameter of the barrel wall 11 so as to produce a satisfactory obturating action. Preferably, the inner edge 10*d* of arm 10*b*, in its quiescent state, has a diameter which is less than the largest diameter d of the spherical section 6*b*. The spherical section 6*b* is dimensioned so that an annular gas 7 exists between its largest diameter d and the barrel wall 11. In order to insure an adequate loading capacity, the diameter of the upper edge 6*a* of the stub case 1 should be less than the diameter of the combustible case 12**.

Figure 3:
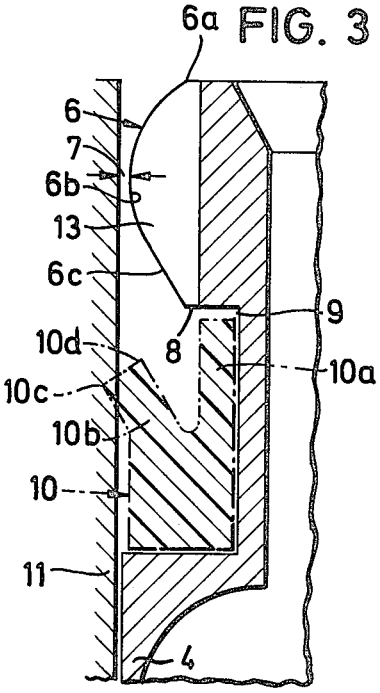
FIG. 3 shows a preferred embodiment of FIG. 2 wherein the annular bead contains a plurality of recesses.

In the preferred embodiment illustrated in FIG. 3, a plurality of axial recesses 13 are distributed along the perimeter of the annular bead 6 so as to facilitate the collecting of the axial streams of gas, which are subject to fluctuations in volume and velocity, within the packing ring 10 thereby rendering them harmless. The recesses 13 may have a rectangular or circular cross-section. The cavities of the recesses 13 should extend inward to as to align with the outer vertical edge of arm **10*a***.

The obturation system of the present invention operates as follows.

Following ignition of the propellant charge enclosed in the combustible case 12, a gas pressure builds up behind the bullet which causes both the movement of the bullet and obturation of the gas as a result of the pressure of the thin-walled case wall against the barrel wall 11. Axial streams of gas which flow back against the barrel wall 11 reach the stub case 1 at its upper edge **6*a* and are then throttled by passing through the annular gap 7. Since the annular gap is followed by an expansion region in which the streams of gas follow the deflection surface 6*c* inwards, a considerable reduction in the gas velocity occurs in this region. The deflection surface 6*c* is dimensioned so that the streams of gas flow into the open arms 10*a* and 10*b* and urge the arm 10*b* with an obturating action against the barrel wall 11** via a radial component of force.

This guiding of the stream of gas between barrel wall 11 and stub case 1 has the decisive advantage that in the event of damage to, and even in the absence of the packing ring, the stream of gas travels the same course; following the deflection surface 6c against the bottom of the annular groove 9 and from there against the barrel wall 11, throttling itself in the process. The effect of the axial recesses 13 is that even surprisingly great surges of gas can be received and throttled and thereby rendered harmless.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A stub case which performs an obturating function on the barrel wall of a firearm, which comprises:

(a) a base;

(b) an annular wall extending from the perimeter of the base;

(c) means for throttling the streams of gas produced by detonation which flow back between the stub case and barrel wall;

(d) means for permitting said streams of gas to expand, depending from said throttling means;

(e) a packing ring fitted around the annular wall of the stub case; and (f) means for directing said expanded streams of gas against the packing ring to cause said ring to expand so as to produce an obturating pressure against the barrel wall.

2. A stub case as recited in claim 1, wherein the throttling means comprises an upper inner edge of the annular wall from which depends a spherical annular bead, the diameter of which is smaller by an annular gap than the diameter of the barrel wall.

3. A stub case as recited in claim 2, wherein the expanding means comprises a tangential deflection surface extending inwardly from the spherical annular bead and an annular groove depending from the deflection surface for receiving the packing ring.

4. A stub case as recited in claim 3, further comprising a horizontal step disposed between the bottom of the deflection surface and the annular groove.

5. A stub case as recited in claim 4, wherein the packing ring comprises a ring of Y-shaped cross-section having a vertical arm fitted against the bottom of the annular groove and an arm extending obliquely outward and bearing against the barrel wall with some obturating pressure.

6. A stub case as recited in claim 5, wherein the annular wall of the stub case is of such thin cross-section, and the inner surface of which is slightly concave, so that the pressure of the gas on the stub case distorts the surface of the annular wall outwardly to provide some obturating action against the barrel wall.

7. A stub case as recited in claim 6, further comprising a plurality of axial recesses disposed along the perimeter of the annular bead and open toward the outer surface.

8. A stub case as recited in claim 7, wherein the axial recesses are circular in cross-section.

9. A stub case as recited in claim 7, wherein the axial recesses are rectangular in cross-section.

10. A method of obturating a stub case on the barrel wall of a gun, which comprises:

(a) receiving axial streams of gas produced by detonation, that flow back on the propellant charge, between the stub case and the barrel wall, then (b) throttling said streams of gas, then (c) expanding said gas within a defined area between the stub case and the barrel wall thereby diminishing the velocity of the gas, and then (d) deflecting the force of said gas to apply pressure against the packing ring or the stub case in such direction as to cause said ring to expand to produce sufficient obturating force against the barrel wall.

* * * * *